US006883768B1

(12) United States Patent
Morin

(10) Patent No.: US 6,883,768 B1
(45) Date of Patent: Apr. 26, 2005

(54) DEVICE FOR HANGING DECORATIVE FIXTURES

(76) Inventor: Denis Morin, 95 N. Canterbury Rd., Canterbury, CT (US) 06331

( * ) Notice: Subject to any disclaimer, the term of this patent is extended or adjusted under 35 U.S.C. 154(b) by 1 day.

(21) Appl. No.: 10/605,494

(22) Filed: Oct. 2, 2003

(51) Int. Cl.[7] ..... B42F 13/00
(52) U.S. Cl. ..... 248/339; 294/19.1; 294/24
(58) Field of Search ..... 248/48.2, 339, 248/304, 301, 58, 61, 60; 294/19.1, 24

(56) References Cited

U.S. PATENT DOCUMENTS

| | | | | | |
|---|---|---|---|---|---|
| 1,197,139 | A | * | 9/1916 | Mastin | 294/19.1 |
| 2,634,999 | A | * | 4/1953 | Fjeld | 81/53.11 |
| 3,181,827 | A | | 5/1965 | Sassin | 248/74 |
| 3,193,229 | A | * | 7/1965 | Stock | 248/74.2 |
| 3,540,687 | A | * | 11/1970 | Cuva | 248/223.41 |
| 3,599,916 | A | * | 8/1971 | Szabo | 248/73 |
| 3,953,065 | A | * | 4/1976 | Shannon, Jr. | 294/1.1 |
| 4,163,576 | A | * | 8/1979 | Hoop | 294/19.1 |
| 5,141,192 | A | | 8/1992 | Adams | 248/231.8 |
| 5,188,332 | A | * | 2/1993 | Callas | 248/544 |
| 5,224,745 | A | * | 7/1993 | Howell | 294/19.1 |
| 5,308,033 | A | * | 5/1994 | Neely, Jr. | 248/229.26 |
| D356,246 | S | | 3/1995 | Adams | D8/395 |
| D356,492 | S | | 3/1995 | Adams | D8/395 |
| 5,553,905 | A | * | 9/1996 | Bentivegna | 294/24 |
| 5,566,058 | A | * | 10/1996 | Protz, Jr. | 362/396 |
| 5,669,709 | A | | 9/1997 | Adams | 362/396 |
| 5,746,461 | A | * | 5/1998 | Broberg | 294/19.1 |
| 5,964,489 | A | * | 10/1999 | Mahoney | 294/24 |
| 6,048,010 | A | * | 4/2000 | Stocker | 294/19.1 |
| D424,418 | S | * | 5/2000 | Gary et al. | D8/395 |
| 6,076,938 | A | | 6/2000 | Kinderman | 362/249 |
| 6,338,460 | B1 | * | 1/2002 | Rumpel | 248/229.16 |
| 6,347,780 | B1 | | 2/2002 | Holbrook | 248/544 |
| 6,659,521 | B1 | * | 12/2003 | Hill et al. | 294/19.1 |

* cited by examiner

*Primary Examiner*—Anita M. King
(74) *Attorney, Agent, or Firm*—Cantor Colburn LLP

(57) ABSTRACT

System and method to easily install and remove hangers for a string of decorative lights around a house or a tree, while standing on the ground and without the use of a ladder. The system and method are particularly intended for attachment to gutter lips, but could be used to attach light strings to a variety of hard to reach surfaces found on and around buildings. The system is comprised of two components, a hanger clip which holds the light string and which is adapted to be suspended by a gutter or tree branch, for example, and an elongated staff configured at one end to temporarily hold the clip until it can be positioned and attached. The staff and hanger clip are engaged by corresponding locking means configured in each, to selectively and temporarily lock the hanger clip at a desired rotation angle relative to an axis defining the elongated staff. In an exemplary embodiment, the hanger clip is configured to simulate an icicle or ornamental object.

21 Claims, 6 Drawing Sheets

DEVICE FOR HANGING DECORATIVE FIXTURES

BACKGROUND OF INVENTION

The present invention relates to a method of installing and displaying decorative lights, such as a continuous strand of Christmas lights, around a house, while standing on the ground, and without the necessity of having to use a ladder. More specifically, the present invention relates to decorative simulated icicles for supporting ornamental lights that may be used during the holiday season.

Decorative lighting fixtures are becoming more sophisticated with every new holiday season. Gone are the days when simple blinking lights strung around trees would suffice to welcome Christmas and the New Year. Today there is a demand for more sophisticated lighting scenarios to adorn homes and buildings. With the demand for new lighting arrangements comes the need for newer and improved flexible frames to support these lighting arrangements and attachment devices to affix such frames to buildings and other structures.

In addition to the increasing demand for more versatile lighting frames, there is a concurrent demand for improved ways and devices for attaching such frames to the building structure. Previously, numerous hooks and hangers for supporting cords and wires, particularly those with ornamental Christmas lights were available to adorn homes. Many of these hooks and hangers were permanently or semi-permanently affixed to the building structure. The installation of these devices was particularly time consuming and laborious and removal was equally complicated. In addition, these devices could not be rearranged at a later date to accommodate changes in the structure of the building or simply to rearrange for a different display of the lights.

Removable hooks such as that disclosed in U.S. Pat. No. 3,181, 827, wherein a clip designed to hold a cord with ornamental lights has an extended portion that fits between shingles and a clip portion that fits around a gutter are also commercially available. Such hooks have many advantages in that they are relatively easy to use and remove but may still be difficult to install onto gutters and other building fixtures or hard to reach structures. Other hooks that hold decorative lights are designed solely to fit between shingles such as those shown in U.S. Pat. Nos. 356,246 and 356, 492, while some such as that described in U.S. Pat. Nos. 5,141, 192 and 6,347,780 are specially designed to mount onto a gutter.

There are a large number of patents related to this field, but there is only two, U.S. Pat. Nos. 5,141,192 and 6,347, 780, that specifically address a solution for installing decorative light hangers to an elevated part of a house, specifically a gutter lip, while standing on the ground and without the use of a ladder. The 6,347,780 patent requires a complex system including a spring-loaded hanger clip having jaws that grip the gutter and a string connected to a hand actuated slider distal from the hanger clip jaws to actuate the same. Furthermore, the 6,347,780 patent requires two-handed operation. The 5,141,192 patent requires the use of an elongated staff with a horizontal rod mounted at one end. In practice, however, this solution requires a difficult and delicate operation to get the hook to seat properly on the wide variety of gutter lips found on houses, particularly when the desired mounting location is at a fairly high elevation (11 feet or more on many houses). Moreover, use of the elongated staff is cumbersome, as there needs to be amble room and the staff long enough to pivot the staff at an end opposite the hook to properly position the hook with respect to the gutter lip extending horizontally from a leading edge defining the gutter toward the house.

Accordingly, a less complex and simpler system is desired for mounting a cord on a gutter and similar hard to reach structures.

SUMMARY OF INVENTION

The above discussed and other drawbacks and deficiencies are overcome or alleviated by an apparatus and method device for mounting a cord on a gutter and similar hard to reach structures, including gutters and trees. The apparatus and method include a hanger clip having a cord retainer and a first bight configured to at least one of clip to two opposing substantially vertical surfaces defining the structure and suspend the hanger clip by the first bight; and an elongated staff for installing and removing the hanger clip. The elongated staff includes a lock feature disposed at one end of thereof to engage a corresponding mating feature extending from the hanger clip for releasably holding the hanger clip, such that when the two sets of features are engaged, the hanger clip is temporarily and securely held onto the elongated staff when either installing or removing the hanger clip to and from the structure from below the structure, wherein disengagement of the two sets of features occurs by rotation of the elongated staff about an axis defining the elongated staff. In an exemplary embodiment, the hanger clip includes a member configured to simulate an icicle or other decorative figure extending from the hanger clip to the corresponding mating feature.

BRIEF DESCRIPTION OF DRAWINGS

Referring to the exemplary drawings wherein like elements are numbered alike in the several Figures.

DETAILED DESCRIPTION

Figure 1:
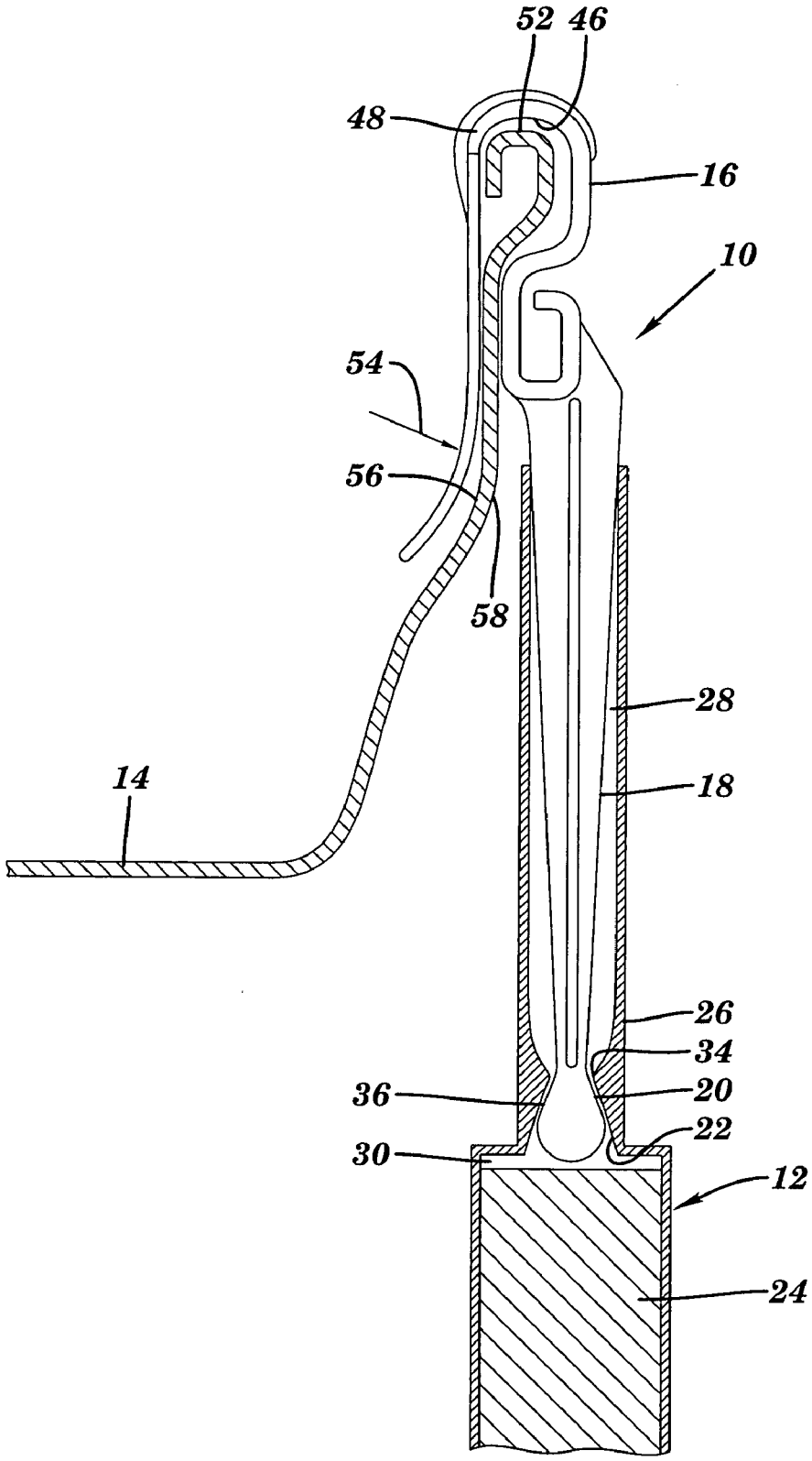
FIG. 1 is a cross section view of an exemplary embodiment of a clip releasably locked to an elongated staff for installation or removal from a gutter.

Referring to FIG. 1, there is shown a perspective view of a hanger clip and elongated staff. Although the present invention will be described with reference to the single embodiment shown in the drawings, it should be understood that the present invention can be embodied in many alternate forms or embodiments. In addition, any suitable size, shape or type of elements or materials could be used.

FIG. 1 illustrates a hanger clip 10 removably coupled to an elongated staff 12 for operably coupling clip 10 to a gutter 14. Hanger clip 10 includes a S-hook 16 and a member 18 extending therefrom and terminating at a lockable profile feature or lock feature 20. Lockable profile feature 20 engages a complimentary lock feature 22 configured in elongated staff 12 for preventing translation of clip 10 in a direction corresponding to an axis defining staff 12.

Elongated staff 12 includes an elongated rod 24 disposed in a hanger clip tool 26 defining one end of staff 12. Tool 26 is configured with complimentary lock feature 22 to selectively and temporarily lock or releasably retain feature 20 at a desired rotation angle relative to an axis defining said elongated staff 12 relative to clip 10. Tool 26 is further configured with a cavity 28 to receive at least a portion of member 18 therein. At an opposite end of tool 26 having cavity 28, a second cavity 30 is configured to receive rod 24 and prevent axial rotation of each relative to one another. In this manner, complimentary lock feature 22 is configured in tool 26 intermediate cavities 28 and 30.

Figure 2:
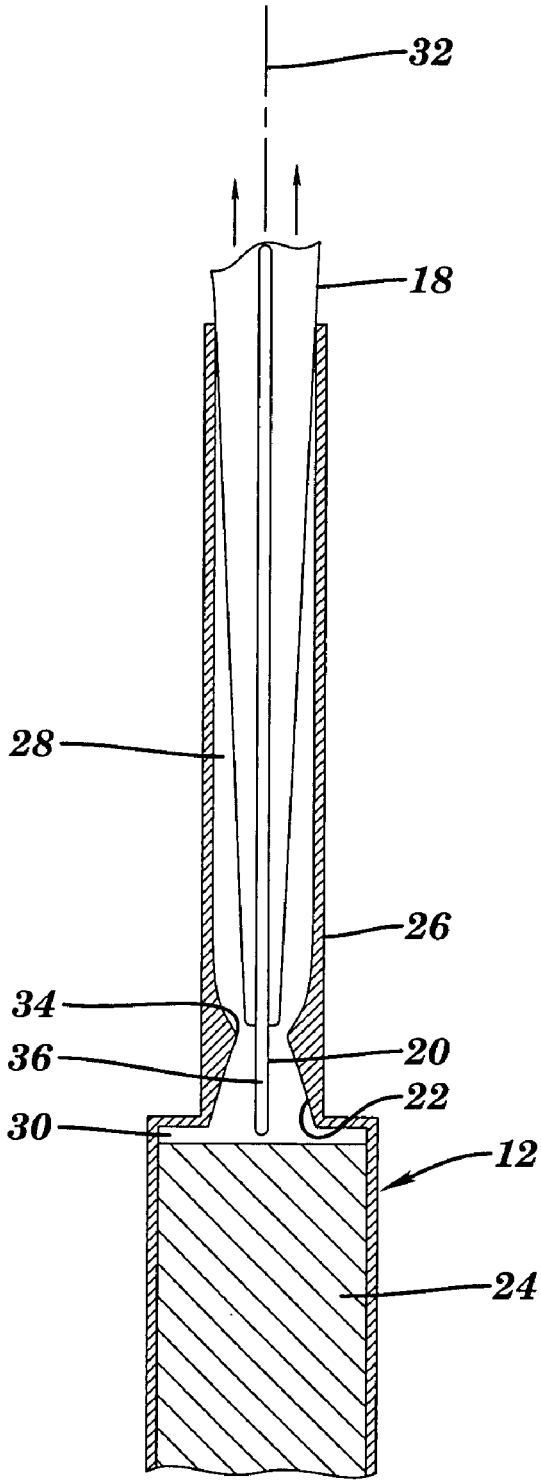
FIG. 2 is a partial cross section view of FIG. 1 illustrating the clip oriented with respect to the elongated staff for removal therefrom.

When the two sets of lock features 20 and 22 are engaged or properly aligned with respect to each other as illustrated in FIG. 1, the hanger clip 10 is temporarily and securely held onto the elongated staff 12 when either installing or removing the hanger clip 10 to and from, respectively, substantially a vertical surface defining a leading edge of gutter 14 therebelow. Disengagement of the two sets of features 20 and 22 occurs by rotation of the elongated staff 12 about an axis 32 defining elongated staff 12 or rod 24 as illustrated in FIG. 2. FIG. 2 illustrates that when lock feature 20 is rotated about 90° about axis 32 relative to the position shown in FIG. 1, lock feature 20 is properly aligned with an aperture 34 defined at an interface between cavity 28 and lock feature 22 such that clip 10 may be separated from elongated staff 12 by translation of staff 12 along axis 32 so that lock feature 20 may be slid through aperture 34 without interference therewith. In this manner, the dimensional profile 36 of lock feature 20 with respect to the dimensions defining aperture 34 is smaller in this orientation. However, the dimensional profile 36 is larger than that of aperture 34 when lock feature 20 is rotated preferably between about 10° to about 170°, and more preferably to about 90°.

Figure 3:
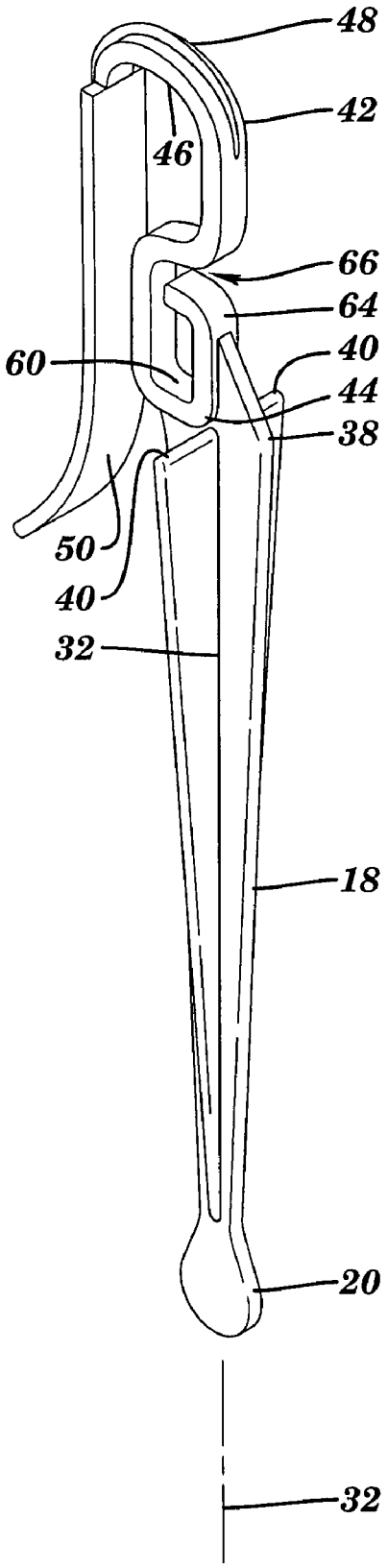
FIG. 3 is a perspective view of the clip of FIG. 1.
Figure 4:
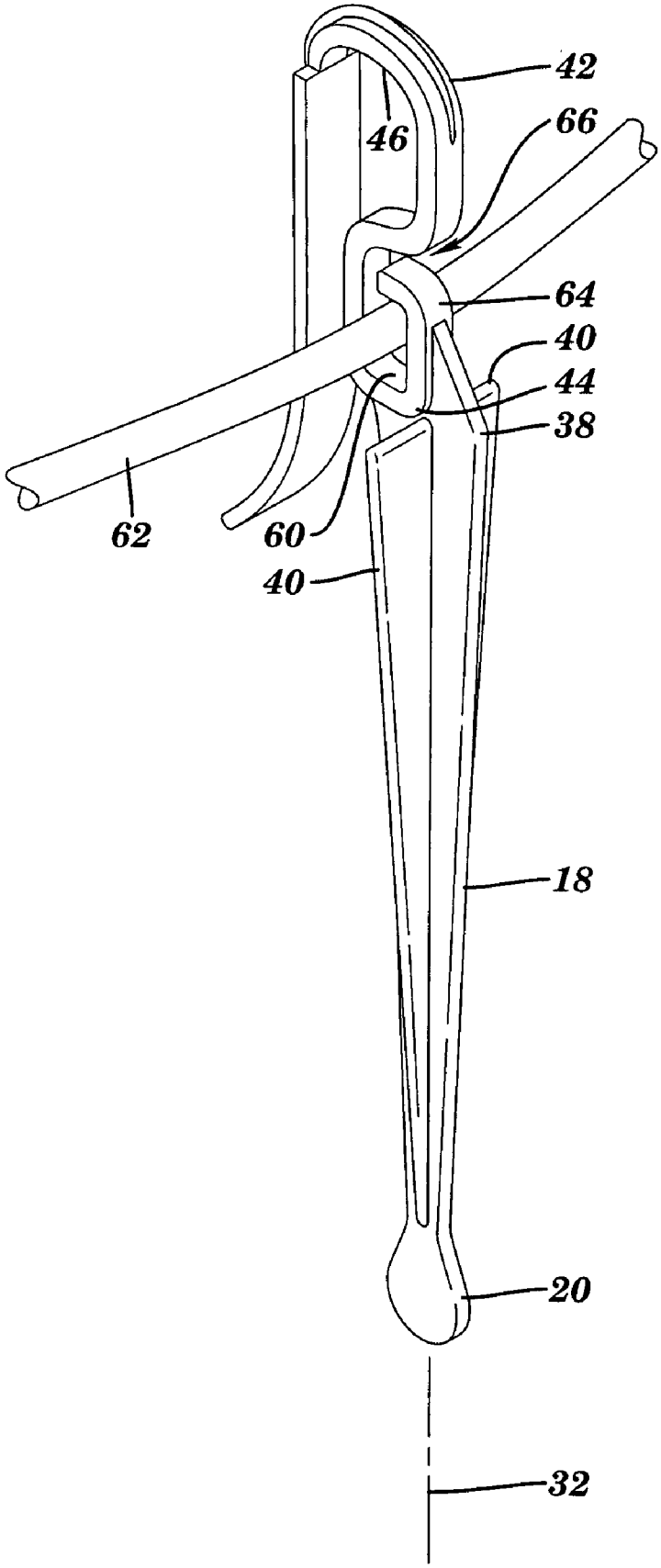
FIG. 4 is another perspective view of the clip having a cord extending therethrough.

Referring now to FIGS. 1, 3 and 4, an exemplary embodiment of hanger clip 10 will be described in more detail. Member 18 disposed intermediate hook 16 and lock feature 20 is preferably configured to simulate an icicle wherein lock feature 20 is appropriately configured to simulate a water drop from the icicle for ornamental design while maintaining the structural design attributes with respect to having a releasable lock profile that is complimentary to lock feature 22. Member 18 resembling an icicle is preferably integrally formed of two planar tapered plates 38 and 40 generally normal to each other intersecting at centerlines 32 defining each and corresponding to axis 32 as best seen in FIG. 3. In this manner, tapered plates 38 and 40 extend to lock feature 20 resembling an icicle with a water drop dripping from an end thereof. However, member 18 may be formed in other configurations suitable to the desired end purpose. For example, member 18 may be formed as another decorative design for use as a Halloween decoration for stringing lights appropriate to the holiday. For example, member 18 may be configured as a devil figurine holding a pitch fork. At the other end of the pitch fork, a corresponding lock feature 20 may be configured to mate with lock feature 22 in tool 26. For instance, the pitch forks defining one end of the pitch fork is optionally utilized to provide the function of lock feature 20. It will be noted that member 18 is not to be limited to simulate just icicles having a water drop lock feature 20 or a devil figurine with a pitch fork lock feature 20, as other decorative and ornamental configurations are contemplated for use with member 18 and lock feature 20.

At an opposite end from attachment with lock feature 20, member 18 is coupled to a bottom portion 44 defining S hook 16. S hook 16 is defined by a top portion 42 and bottom portion 44. Top portion 42 includes a first bight 46 defined by a substantially U-shaped member 48 that terminates in a flared out portion 50 that is substantially wider than the remaining portion defining U-shaped member 48. Flared out portion 50 is configured to easily allow a gutter lip 52 defining a top leading edge of gutter 14 to slide by flare out portion 50 toward bight 46. Clip 10 is suspended by first bight 46 being suspended by gutter lip 52. Flared out portion 50 is preferably configured to provide a bias 54 against an inside surface 56 defining a leading edge 58 of gutter 14. Flared out portion 50 is preferably wider than a remaining portion defining hook 16 in order to facilitate assembly and disassembly of clip 10 with a gutter 14 or similar hard to reach structure. Flared out portion 50 is widera remaining portion defining U-shaped member 48 to orient hook 16 substantially parallel with the leading edge of the gutter and prevent the clip 10 from twisting when staff 12 is engaged and disengaged therefrom.

Bottom portion 44 of S hook 16 includes a second bight 60 configured to accommodate and help restrain a cord 62 therein (FIG. 4). In an exemplary embodiment, cord 62 is light string of a plurality of ornamental lights, however, cord 62 may include one or more cords suitable for the desired purpose. In an exemplary embodiment, cord 62 is preferably encompassed in bottom portion 44 configured as a spiral section 64 defined by a small entry 66 so that removal of cord 62 from second bight 60 is less prone due to wind, for example, or during installation of clip 10.

Figure 5:
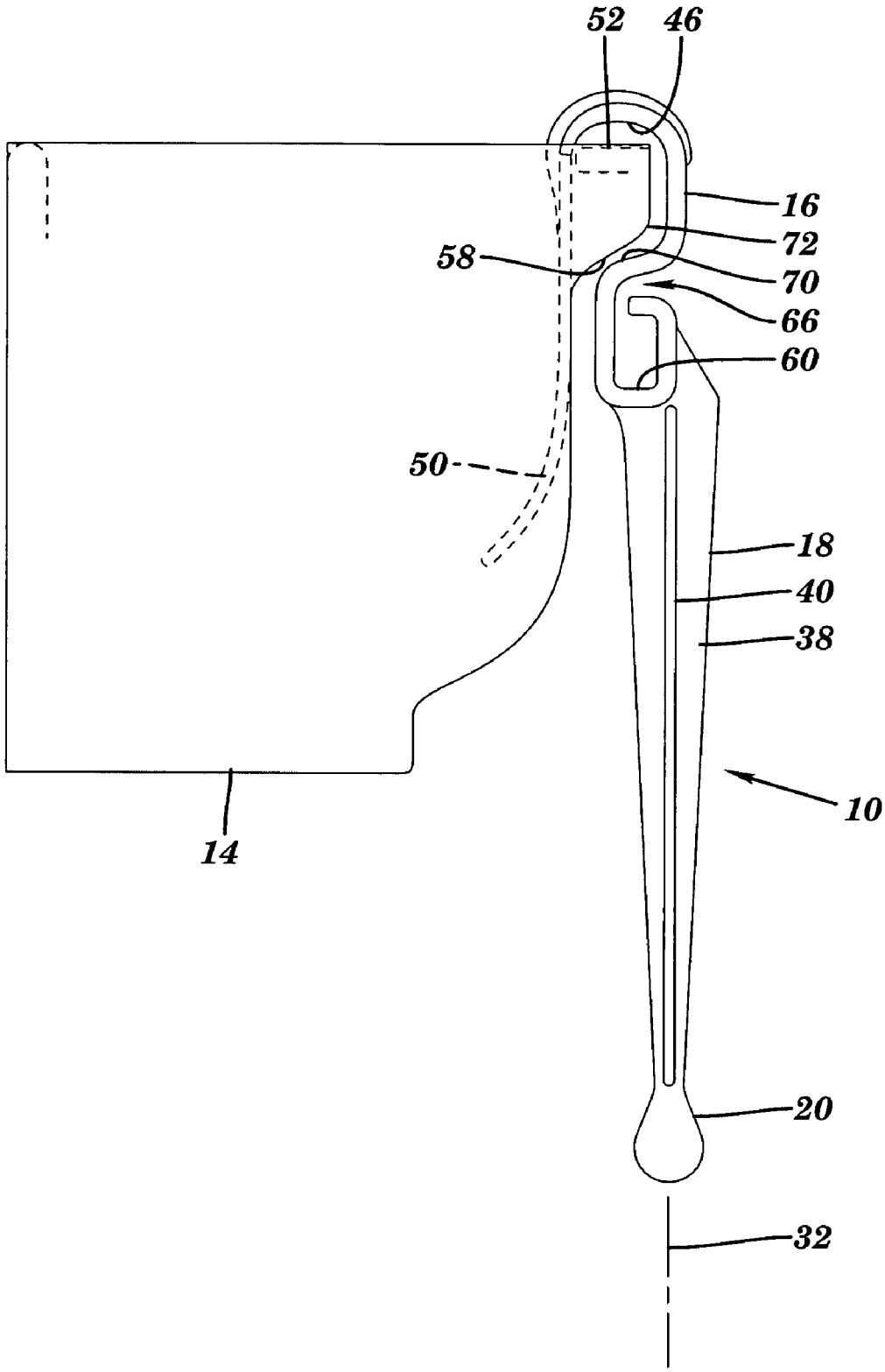
FIG. 5 is a cross section view of the clip of FIG. 1 illustrating attachment over a gutter lip and releasable profile engagement therebetween.

Referring now to FIG. 5, hanger clip 10 preferably includes bottom portion 44 of S hook 16 configured with a clip profile 70 complimentary to a gutter profile 72 of leading edge 58 such that vertical translation of clip 10 relative to leading edge 58 is inhibited by abutment between the complimentary configured profiles 70 and 72. Clip profile 70 corresponds to an interface between top and bottom portions 42 and 44 of S hook 16, but is not limited thereto, as clip profile 70 may depend from other suitable locations of hook 16. Furthermore, first bight 46 is configured to properly receive and be suspended by gutter lip 52.

Referring to FIGS. 1, 2 and 5, the method of suspending the device from a gutter is displayed. A cord is passed through the opening 66 in hook 16 (as seen in FIG. 4, not shown here). The clip 10 is attached to tool 26, which is itself connected to elongated shaft 12. The clip 10 is suspended over gutter lip 52, which extends inwardly from the termination of the gutter trough. The clip 10 is then lowered over lip 52 so that spiral curvature or profile 70 is in contact with a complimentary configured profile 72 in an outside face of lead edge 58. The clip 10 may then be slidingly positioned as being suspended by gutter lip 52 so that contiguous clips 10 may be evenly or proportionately displaced from one another. Clip 10 is then firmly mounted while being suspended on the gutter lip 52 by pinching the gutter trough 14 on both sides defining leading edge 58 with clip profile 70 engaged with gutter profile 72 and flared out portion 50 biasing from inside the gutter trough. The clip 10 is then operably removed from tool 26 by rotating staff 12 approximately 90° about axis 32 so that the orientations of features 20 and 22 shown in FIG. 1 become oriented as in FIG. 2. Then tool 26 is removed from clip 10 by pulling downward on the elongated shaft 12. Gutter lip 52 thus slides into first bight 46, distorting flared out portion 50 which then grips an inside face defining leading edge 58 of the gutter trough.

Removal of the clip is simply the reversal of the steps previously mentioned, i.e. insertion of the rod into the clip with feature 22 aligned with aperture 34 to slide therethrough, rotation of the tool 26 by about 90° to engage complimentary lock features 20 and 22, raising the clip slightly away from to the ground to disengage the clip 10 with the leading edge 58 of the gutter trough, and lowering the clip disposed at the end of the elongated shaft to the ground below.

In accordance with an embodiment of the invention, hanger clip 10 and tool 26 are each preferably constructed from a rigid material such as plastic. However, it is considered within the scope of the invention that hanger clip 10 and tool 26 may be constructed from any material suitable to the desired end purpose. In an exemplary embodiment, each of hanger clip 10 and tool 26 is integrally molded, using injection molding, for example. Further, hanger clip 10 is preferably molded with a plastic having a color to simulate the color of an icicle such as clear or white plastic.

In accordance with an embodiment of the invention, elongated rod 24 is preferably constructed from a rigid material such as plastic or wood. However, it is considered within the scope of the invention that elongated rod 24 may be constructed from any material suitable to the desired end purpose. For example, it is contemplated that elongated rod 24 may be a common household threaded broom handle, wherein tool 26 is molded with complimentary threads to receive the threaded broom handle. Other embodiments are contemplated as well, including, but not limited to, mechanical and chemical bonding means and press fit engagement therebetween (e.g., between tool 26 and rod 24).

Figure 6:
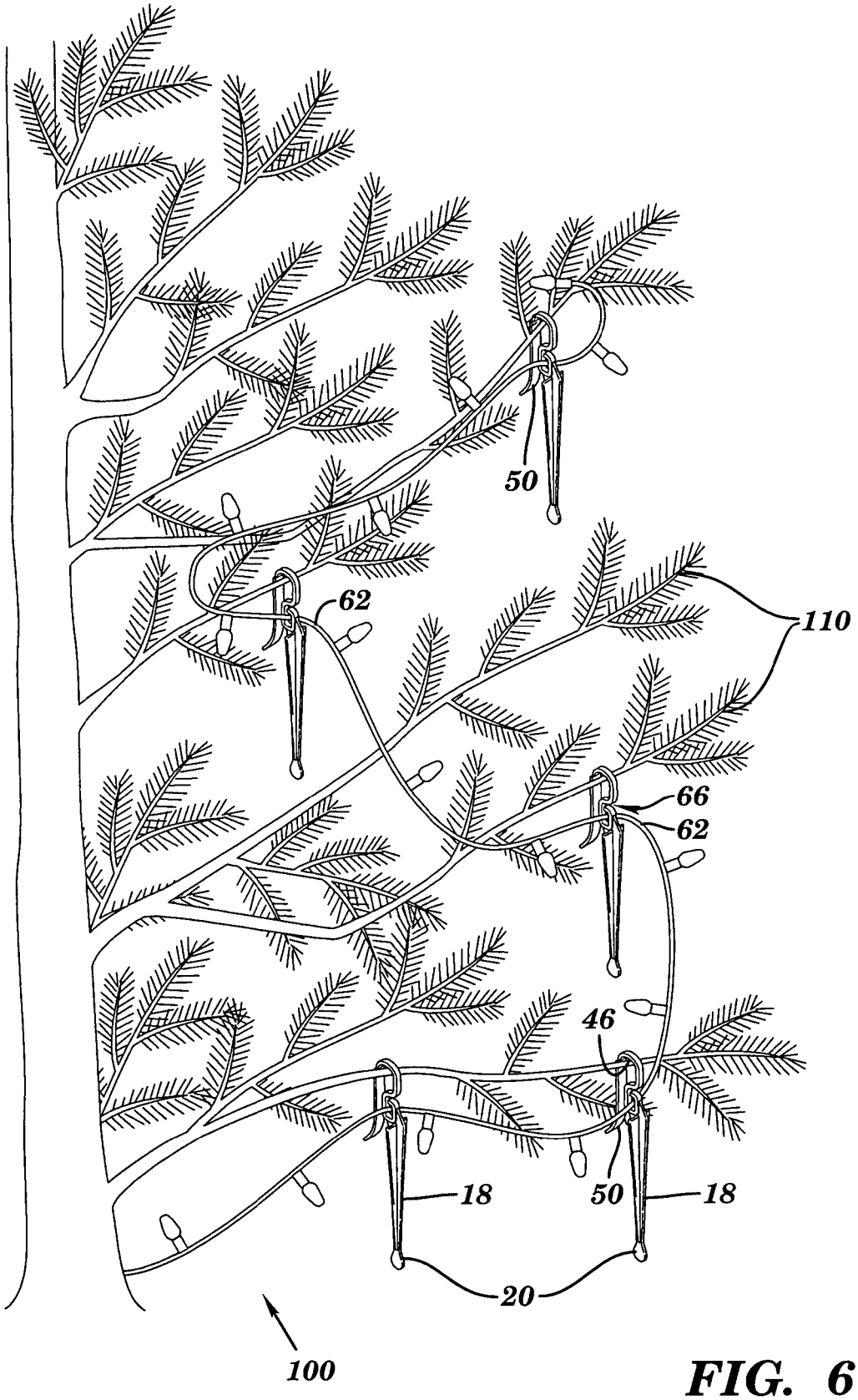
FIG. 6 is a schematic illustration of an alternative embodiment of the clip of FIG. 1 used to hang a cord of hanging lights in a tree.

Referring now to FIG. 6, clip 10 is illustrated being used to suspend cord 62 in a tree 100 without the use of a ladder. As described above with reference to being suspended by a gutter lip 52, FIG. 6 illustrates that clip 10 may be suspended from branches 110 extending from tree 100 using staff 12 without employing a ladder. In this manner, one or more strings of lights may be strung around tree 100 while clips 10 simulate icicles hanging therefrom.

The above described embodiments allow hanging a string of lights on an ice-laden day without a ladder perched on the slippery ground. In addition, the need to wait until a winter thaw to remove the lights is avoided, because the need for a ladder is eliminated. The above described system allows stringing lights on any standard gutter or branches of a tree and allows removal of the same with just an upward nudge with the elongated staff on the releasably locked clip so that the clip may be easily lowered to the ground with the cord of strung lights still attached to the clip. Furthermore, the above operation may be easily done with one hand from beneath the gutter or branch without awkward angling of the staff to properly seat or unseat the clip.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A device for mounting a cord on a gutter and similar hard to reach structures comprising:

a hanger clip having a cord retainer and a first bight, said first bight configured to suspend said hanger clip; and an elongated staff for installing and removing said hanger clip, said elongated staff having a lock feature disposed at one end of said elongated staff to engage a corresponding mating feature extending from said hanger clip for releasably holding said hanger clip, such that when the features are engaged, said hanger clip is temporarily and securely held onto said elongated staff when one of installing and removing said hanger clip to and from the structure from below the structure, wherein disengagement of the features occurs by rotation of said elongated staff about an axis defining said elongated staff.

2. The device of claim 1, further comprising a member configured to simulate one of an icicle and a decorative figure, said member extending from said hanger clip to said corresponding mating feature.

3. The device of claim 2, wherein said member configured to simulate said icicle is formed of two generally planar plates defined by tapered sides intersecting one another along centerlines defining each and defined with said tapered sides substantially normal to each other.

4. The device of claim 1, wherein said hanger clip is formed of extruded plastic.

5. The device of claim 1, wherein said hanger clip is configured substantially as an S hook defined by said first bight configured to fit over a gutter lip and contour to at least a bight portion in a gutter and a second bight having said cord retainer.

6. The device of claim 5, wherein said first bight of said S hook is configured to extend below said second bight of said S hook to clip against an inside surface defining said leading edge of said gutter.

7. The device of claim 6, wherein said first bight of said S hook is configured generally wider than a remaining portion of said hanger clip and extends below said second bight of said S hook to provide a resilient bias against an inside surface defining said leading edge of said gutter.

8. The device of claim 6, wherein said first bight terminates in an open flare configured to allow said gutter lip therethrough.

9. The device of claim 5, wherein said second bight is configured so as to accommodate at least one cord therethrough.

10. The device as described in claim 1, wherein said hanger clip is configured to specifically contour around a gutter lip and to at least one of two opposing surfaces defining a bight in a leading edge defining said gutter.

11. The device as described in claim 1, wherein the features engage in a direction along said axis defining said elongated staff via a complimentary lockable profile on each of the features, such that rotation of one of the features provides a lockable profile orientation to keep said hanger clip securely and temporarily engaged onto said elongated staff while limited rotation of one of the features relative to the other disengages the same.

12. The device of claim 11, wherein said limited rotation is substantially less than 180° of rotation about said axis.

13. The device of claim 1, wherein said cord retainer is configured as a spiral configured to retain at least one cord.

14. The device of claim 1, wherein said hanger clip and said elongated staff are engaged by the features as a locking means, to selectively and temporarily lock the hanger clip at a desired rotation angle relative to said elongated staff and about said axis.

15. The device of claim 14, wherein said locking means is comprised of a complimentary configured lockable feature combination, wherein when a complimentary profile of each feature is aligned with the other essentially coincident with said axis of rotation via rotation thereof about said axis, said device may be disengaged from said elongated staff via translation in a direction corresponding to said axis.

16. The device of claim 15, wherein when said complimentary profile of said each feature is misaligned with the other upon respective rotation of either essentially coincident with said axis of rotation, said device is engaged with said elongated staff and translation in a direction corresponding to said axis is prohibited.

17. The device of claim 1, wherein said hanger clip is operably suspended from one of thee gutter and a tree branch.

18. A method for mounting a cord on a gutter and similar hard to reach structures comprising the steps of:

configuring a hanger clip having a cord retainer and a first bight, said first bight configured to suspend said hanger clip with said first bight;

using an elongated staff for installing and removing said hanger clip, said elongated staff having a lock feature disposed at one end of said elongated staff; and engaging a corresponding mating feature extending from said hanger clip with said lock feature for releasably holding said hanger clip, such that when the features are engaged, said hanger clip is temporarily and securely held onto said elongated staff when one of installing and removing said hanger clip to and from the structure from below the structure, wherein disengagement of the features occurs by rotation of said elongated staff about an axis defining said elongated staff.

19. The method of claim 18, further comprising:

configuring a member to simulate one of an icicle and a decorative figure, said member extending from said hanger clip to said corresponding mating feature, and configuring said corresponding mating feature to simulate one of a water drop and a corresponding ornamental figure extending from said member.

20. The method of claim 18, wherein said configuring said member to simulate said icicle is formed of two generally planar plates defined by tapered sides intersecting one another along centerlines defining each and defined with said tapered sides substantially normal to each other.

21. A device comprising:

a hanger clip having a cord retainer and a first bight; and an elongated staff for installing and removing the hanger clips, the staff having a lock feature disposed at one end to engage a corresponding mating feature extending from the hanger clip, such that when the features are engaged, the hanger clip is temporarily and securely held onto the staff when one of installing and removing the hanger clip to and from the structure from below the structure, and wherein disengagement of the features occurs by rotation of the staff about an axis defining the elongated staff.

* * * * *